US005602522A

United States Patent [19]

Pacelli

[11] Patent Number: 5,602,522

[45] Date of Patent: Feb. 11, 1997

[54] VISUAL SIGNALING SYSTEM

[75] Inventor: John R. Pacelli, Holland, Mich.

[73] Assignee: Gentex Corporation, Zeeland, Mich.

[21] Appl. No.: 188,022

[22] Filed: Jan. 28, 1994

[51] Int. Cl.[6] ..... G08B 5/00

[52] U.S. Cl. ..... 340/331; 340/332; 340/691; 340/908; 315/200 A; 315/209 SC; 315/241 S; 315/194

[58] Field of Search ..... 340/331, 332, 340/908, 908.1, 691; 315/200 A, 209 SC, 241 S, 194

[56] References Cited

U.S. PATENT DOCUMENTS 5,010,336 4/1991 Mosele et al. ..... 340/907
5,015,918 5/1991 Copeland ..... 315/76
5,128,591 7/1992 Bocan ..... 315/200 A
5,373,215 12/1994 Steinkraus ..... 315/200 R

*Primary Examiner*—Jeffery Hofsass
*Assistant Examiner*—Daryl C. Pope
*Attorney, Agent, or Firm*—Malcolm R. McKinnon

[57] ABSTRACT

A visual signaling system is provided incorporating strobe light means which emits flashes of light at a constant rate, as distinguished from a random rate, despite variations in input voltage applied to the system. The system enables predetermined signals to be perceived by persons in high decibel areas or by heating impaired persons, and multiple signaling units may be incorporated in a multistation system whereby the strobe lights in each of the signaling units all flash simultaneously at a synchronized rate, as distinguished from independently or at random rates.

6 Claims, 3 Drawing Sheets

VISUAL SIGNALING SYSTEM

BRIEF SUMMARY OF THE INVENTION

This invention relates to visual signaling systems and, more particularly, to an improved visual signaling system particularly adapted for use in attracting the attention of persons in high decibel areas and/or for use in attracting the attention of hearing impaired persons, although it will be understood that the present invention is also applicable to other uses.

Heretofore, various signaling systems have been utilized in areas of commercial and residential buildings as well as in outside areas for the purpose of attracting the attention of persons in such areas, as for example, to warn of the danger of a fire or to alert such persons to a telephone call or for myriad other purposes. Many prior signaling systems emit an audible signal, but an audible signal may not provide an adequate warning for hearing impaired persons or for persons in high decibel areas, so that it is possible that an audible signal may not be heard under noisy environmental conditions even by persons having unimpaired hearing. Heretofore, visual signaling systems have also been provided which include incandescent lighting, often in conjunction with a polished reflector, the incandescent lighting means, and often also an audible alarm, being energized when it is desired to signal persons in the area. However, the light from such prior signaling systems may not be visible even at relatively short distances under heavy smoke or other adverse visual conditions with the result that occupants of a noisy environment or hearing impaired persons may not be alerted even though the signaling system has sounded an audible alarm and also energized a light. In an effort to overcome the aforementioned as well as other disadvantages in prior signaling systems, visible alarms have been provided which incorporate strobe light means together with lens means for directing and focusing light rays emitted by the strobe light means. However, prior signaling systems incorporating strobe light means of the indicated character have been subject to the deficiency that the strobe lights tend to flash at random rates, and it has been found that persons subject to photosensitive epileptic seizures may experience such seizures as a result of the random flashing of the strobe lights. Moreover, if multiple signaling devices are connected together and flash at different rates, persons subject to photosensitive epileptic seizures may experience such seizures as a result of the different flashing rates of the multiple signaling devices. However, it has been found that if the strobe lights flash at a constant rate or if the strobe lights in a multiple signaling system all flash at the same time and at a constant rate, such effect may be helpful in preventing photosensitive epileptic seizures. In addition, it has been found that if the strobe lights flash at a constant rate and multiple strobe lights flash at a synchronized rate rather than at a random rate, the system may be utilized to emit predetermined signals which may be identified by particular persons or which may indicate particular levels of alarms or other conditions.

An object of the present invention is to overcome the aforementioned as well as other disadvantages in prior visual signaling systems of the indicated character and to provide an improved visual signaling system incorporating strobe light means capable of emitting flashes of light at a constant rate, as distinguished from a random rate, despite variations in voltage applied to the system.

Another object of the present invention is to provide an improved visual signaling system which may be helpful in preventing photosensitive epileptic seizures.

Another object of the present invention is to provide an improved visual signaling system incorporating improved means for energizing strobe light means whereby the frequency of the flashing of the strobe light means remains unchanged over a wide range of input voltages to the system.

Another object of the present invention is to provide an improved visual signaling system incorporating improved means for emitting predetermined signals in the form of a code which may be perceived by persons in high decibel areas or by hearing impaired persons.

Another object of the present invention is to provide an improved visual signaling system capable of reliably warning hearing impaired persons under adverse visibility conditions.

Another object of the present invention is to provide an improved visual signaling system incorporating improved signaling means which may be easily noticed by hearing impaired persons or by persons occupying a noisy environment.

Still another object of the present invention is to provide an improved visual signaling system that is economical to manufacture and assemble, durable, efficient and reliable in operation.

The above as well as other objects and advantages of the present invention will become apparent from the following description, the appended claims and the accompanying drawings.

DETAILED DESCRIPTION

Figure 1:
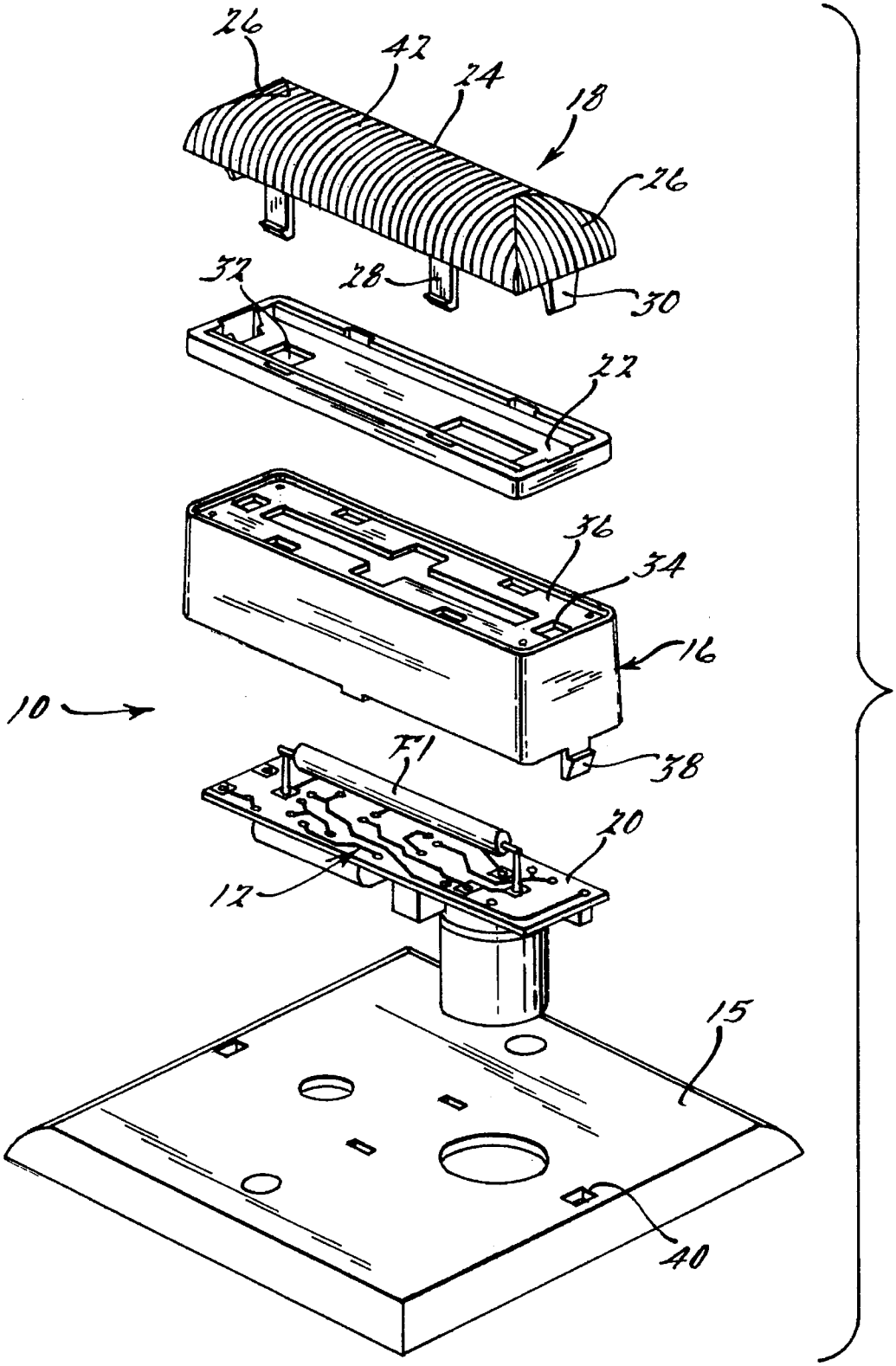
FIG. 1 is an exploded perspective view of a signaling unit embodying the present invention.

Referring to FIG. 1, a visual signaling unit, generally designated 10, embodying the present invention is illustrated therein. The signaling unit 10 includes circuitry, generally designated 12, which will be described hereinafter in greater detail and which is adapted to be connected to a conventional 24 volt dc power source. The signaling unit 10 also includes a base or face plate 15, and a base housing, generally designated 16, which is adapted to house the circuitry 12. The signaling unit 10 further includes a lens, generally designated 18, adapted to focus and direct light emitted by a flash tube F1 incorporated in the circuitry 12. The components of the circuitry 12, which will be described hereinafter in greater detail, are preferably mounted on a circuit board 20, the flash tube F1 preferably being disposed on the upper side of circuit board 20, as viewed in FIG. 1. Preferably, the flash tube is a Xenon flash tube having a gas tube filled with an ionizing gas. The flash tube F1 is disposed in spaced relationship with respect to the circuit board 20, and a conventional parabolic reflector 22 is provided which is disposed between the circuit board and the flash tube F1.

The lens 18 has a main body portion 24 with a generally parabolic in cross-section, and arcuate end portions 26. The main body portion 24 includes a plurality of locking tabs, such as 28 and 30, which project through openings, such as 32, in the reflector and which engage locking apertures, such as 34 provided in the top wall 36 of the housing 16. The base housing 16, in turn, is provided with locking tabs, such as 38, which project past the ends of the circuit board and engage locking apertures, such as 40, provided in the base or face plate 15. With such a construction, the entire unit may be readily assembled by merely inserting the locking tabs in their associated locking apertures in a conventional manner so as to provide a unitary structure.

The lens 18, which is preferably made of clear plastic material, such as Lexan, marketed by General Electric Company, uses geometrical optics to direct and focus the light emitted from the flash tube F1. The lens 18 may be of a modified Fresnel design having segments, such as 42, of a generally saw tooth configuration, the lens 18 magnifying the light emitted from the flash tube F1 and focusing and directing substantially all usable light to form a concentrated pattern frontwardly of the flash tube F1. Thus, the light focusing by the lens 18 increases the efficiency of the flash tube F1 by producing a concentrated pattern in front of the lens. In the embodiment of the invention illustrated, and with the circuitry 12 incorporating the components hereinafter identified, the light focusing produces light output of 15 candela when measured from a distance of ten feet straight in front of the lens.

Figure 2:
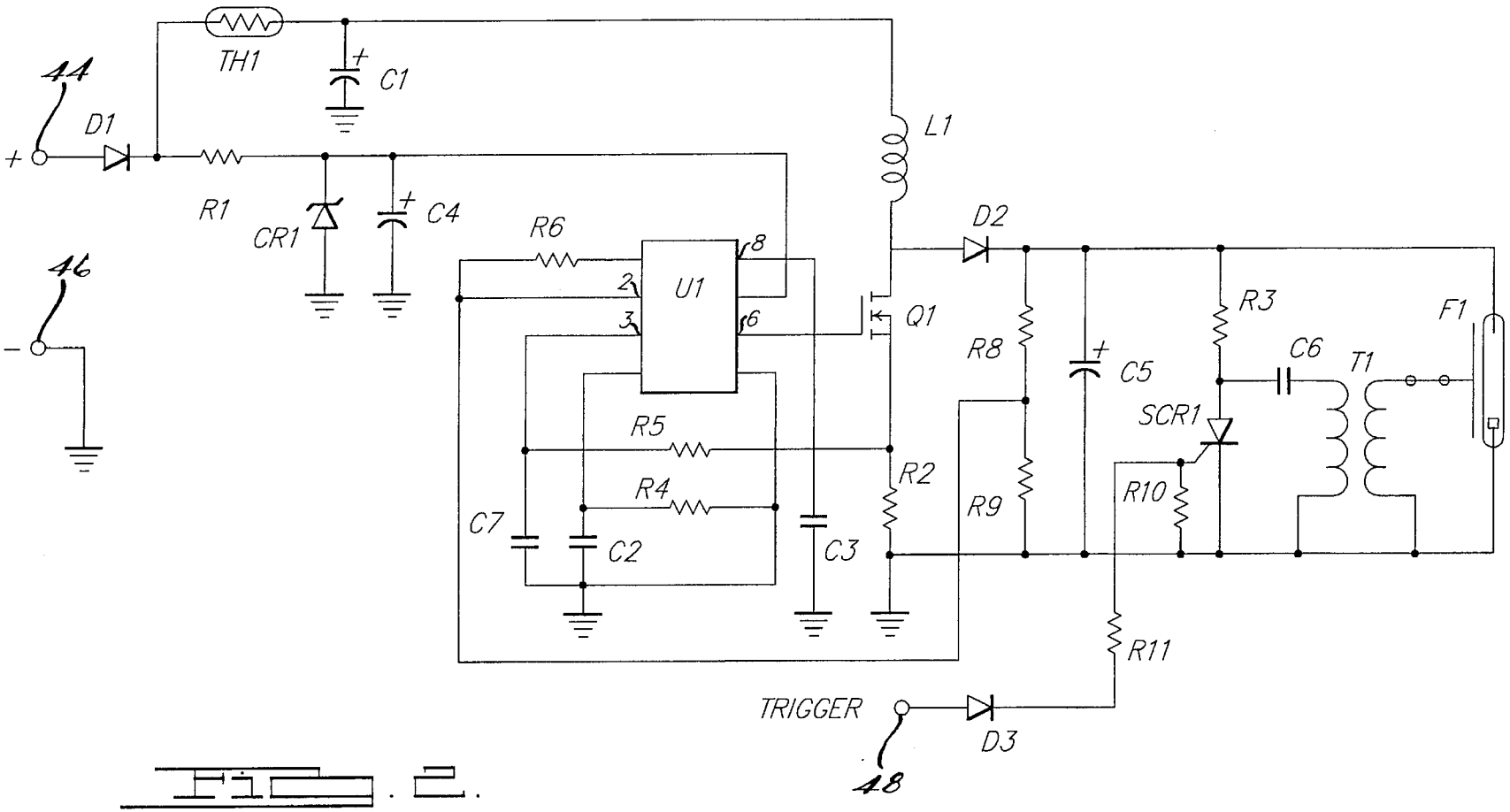
FIG. 2 is a schematic electrical circuit diagram of a signaling system embodying the present invention.

Referring to FIG. 2, the circuitry 12 is schematically illustrated therein and is comprised of a thermistor TH1, resistors R1 through R11, an inductor L1, diodes D1 through D3, a zener diode CR1, capacitors C1 through C6, a field effect transistor Q1, a conventional switching regulator U1, a silicon controlled rectifier SCR1, a trigger coil T1, and a flash tube F1. In the embodiment of the invention illustrated, the circuitry 12 is adapted to be connected to a conventional source of 24 volt dc power at the terminals 44 and 46, and the various components thereof are electrically connected by suitable conductors as illustrated in FIG. 2 and as will be described hereinafter in greater detail. The circuitry 12 also includes a trigger terminal 48 which may be connected to the ringing circuit of a telephone, to the alarm circuit of a smoke detector, or to any other desired source of triggering signal, either manual or automatic.

In the operation of the unit 10 the 24 volt dc input power is polarized by the diode D1. This prevents the application of reversed power leads from causing any destructive current flow through the circuit. The capacitor C1 is provided to minimize fluctuating current demands on the power source. The thermistor TH1 limits the inrush current. When the flash tube F1 powers up, the current passing through the thermistor TH1 reduces the resistance of the part so that it minimizes any impact on the steady state operation of the flash tube F1. The resistor R1 limits the amount of current flow through the zener diode CR1. The zener diode CR1 establishes a regulated voltage source for the switching regulator U1. The capacitor C4 provides power filtering when unfiltered, full wave rectified dc voltage is provided at the input terminals. The capacitor C3 is a bypass filter for the reference voltage provided by pin 8 of the switching regulator U1. The resistor R4 and the capacitor C2 determine the frequency at which an internal oscillator will operate. The resistor R2 is a current sense resistor which allows the pulse width modulator to operate in the current mode. The resistor R5 and the capacitor C7 provide an RC filter network to reduce the effects of transient signals at the comparator's input on pin 3 of U1. The pin 6 of U1 controls the conduction state of the field effect transistor Q1 by pulling the gate of Q1 to the positive or negative rail. The period that Q1 is turned on is determined by the oscillator period and current sense resistor R2. As the input voltage to the circuit varies, the rate at which the current will flow through the inductance L1 will also change. A constant peak current through the inductance L1 is maintained by the current sense resistor R2. Once the peak is reached, the current sense resistor R2 will change the output state of the comparator at pin 3 and turn off the field effect transistor Q1. Q1 will again be turned on once one oscillator period is completed. Since the time the field effect transistor Q1 is on is determined both by oscillator frequency and the current sense resistor R2, the pulse applied to the gate of Q1 will vary with input voltage. This in turn will keep the charge rate of the capacitor C5 constant. After the field effect transistor Q1 has turned on for a period of time, current flow through the inductor L1 will cause a certain level of energy to be stored in the inductor L1. When Q1 is turned off, the energy stored by the inductor L1 will flow through the diode D2 and into the capacitor C5. The diode D2 is a fast recovery diode which will allow current to flow into the capacitor C5 and prevent any energy from escaping once the energy transfer between the inductor and capacitor is complete. With each oscillation of the switching regulator U1, the capacitor C5's voltage level will ramp upwards. Once the voltage level of the capacitor C5 equals the steady state voltage determined by the resistor divider network established by the resistor R8 and the resistor R9, the switching regulator U1 will maintain Q1 in the non conduction state. This feedback signal is fed into pin 2 of the switching regulator U1. The resistor R6 establishes the closed loop gain of the feedback network at approximately 10. A small amount of current will also flow through the resistor R3 into the capacitor C6. The silicon controlled rectifier SCR1 will maintain an open circuit in the loop through the capacitor, trigger coil transformer and silicon controlled rectifier. The resistor R10 is provided to prevent any stray signals from false triggering the silicon controlled rectifier. Once an input pulse is applied through the terminal 48, the diode D3 and the resistor R11, SCR1 will go into conduction. The diode D3 polarizes the input signal and allows for circuit supervision. The resistor R11 limits the amount of current flow through the gate of the silicon controlled rectifier. The conduction state of the silicon controlled rectifier provides a current path through the primary of the trigger coil T1. A high voltage pulse is induced at the secondary of T1 and is applied to the glass encasement of the flash tube F1. This ionizes the Xenon gas causing it to go into conduction. The energy stored by the capacitor C5 is then dissipated through the flash tube F1 primarily in the form of light. It will be understood that predetermined input pulses may be applied to the trigger terminal 48, as for example, pulses in the nature of a Morse or other code, to attract the attention of particular persons knowledgeable of the code.

The following is an identification of various components of the circuitry 12 described above, it being understood that these specified components may be varied depending upon the particular applications of the principles of the present invention.

| | |
|---|---|
| TH1 | Thermistor #2C20102 |
| R1 | 1.8 k, ¼ w, 5% |
| R2 | 3.9, ¼ w, 5% |
| R3 | 100 k, ¼ w, 5% |
| R4 | 10 k, ¼ w, 5% |
| R5 | 2.2 k, ¼ w, 5% |
| R6 | 100 k, ¼ w, 5% |
| R8 | 1M, ¼ w, 1% |
| R9 | 10.7 k, ¼ w, 1% |
| R10 | 1k, ¼ w, 5% |
| R11 | 3.3 k, ¼ w, 5% |

-continued

| | |
|---|---|
| L1 | 1 mH |
| D1 | 1N4004 |
| D2 | 1N4936 |
| D3 | 1N4004 |
| CR1 | 1N5240 |
| C1 | 47uF, 50 v or greater, Alum. Elec. |
| C2 | 0.01 uF, axial ceramic capacitor |
| C3 | 0.1 uF, axial ceramic capacitor |
| C4 | 3.3 uF, 16 v or greater, Alum. Elec. |
| C5 | 47 uF, 250 v, Alum. Elec. |
| C6 | 0.047 uF, 400 v Metallized Polyester |
| Q1 | IRF820 FET |
| U1 | Switching Regulator Micrel MIC38C43BN |
| SCR1 | MCR22-6 SCR |
| T1 | Trigger Coil, ZS 1052 |
| F1 | BGA 1020 GX-# Flash Tube |

It has been found that when the circuitry 12 incorporates the foregoing components, the frequency of the flashing of the flash tube F1 remains constant when the input voltage at the terminals 44 and 46 varies over a range from 16.8 vdc to 33 vdc.

Figure 3:
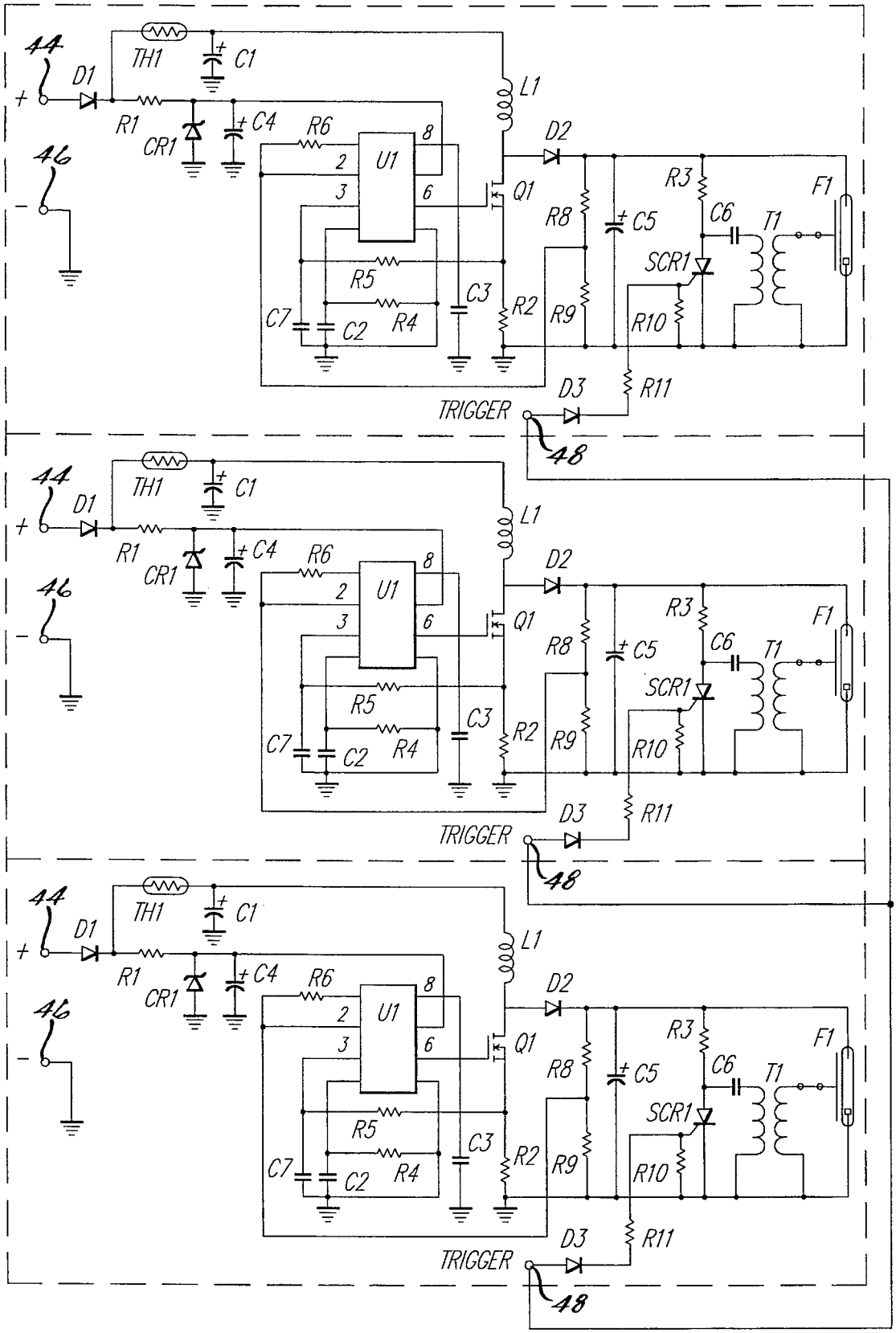
FIG. 3 is a schematic electrical circuit diagram of a signaling system incorporating multiple signaling units embodying the present invention.

FIG. 3 illustrates the manner in which multiple signaling units 10 may be incorporated in a multistation system whereby the flash tubes in all of the signaling units flash simultaneously at a synchronized rate, as distinguished from independently or at random rates. As shown in FIG. 3, the triggers of each of the signaling units are connected together in such a multistation system. It will be understood that each of the multiple signaling units is preferably constructed in the manner previously described in connection with the circuitry illustrated in FIG. 2.

While preferred embodiments of the invention have been illustrated and described, it will be understood that various changes and modifications may be made without departing from the spirit of the invention.

What is claimed is:

1. A visual signaling system for simultaneously flashing multiple strobe lights, said system comprising, in combination, a plurality of separate signaling units, means for providing dc electrical power to each of said units, each of said units incorporating a strobe light operable to emit flashes of light, capacitor means for storing power and electrically connected to said means for providing electrical power, means for achieving and maintaining a steady state voltage on said capacitor means, and means electrically connected to each of said strobe lights and electrically connected with said means for storing power for periodically electrically energizing each of said strobe lights whereby all of said strobe lights simultaneously emit flashes of light, said system also including means electrically connectable to said means for providing dc electrical power for polarizing said electrical power.

2. A visual signaling system for simultaneously flashing multiple strobe lights, said system comprising, in combination, a plurality of separate signaling units, means for providing dc electrical power to each of said units, each of said units incorporating a strobe light operable to emit flashes of light, capacitor means for storing power and electrically connected to said means for providing electrical power, means for achieving and maintaining a steady state voltage on said capacitor means, means electrically connected to each of said strobe lights and electrically connected with said means for storing power for periodically electrically energizing each of said strobe lights whereby all of said strobe lights simultaneously emit flashes of light, said system including means electrically connectable to said means for providing dc electrical power for polarizing said electrical power, said system including thermistor means electrically connected in series with each of said strobe lights and effective to limit electrical current applied to said strobe lights from said means for providing electrical power.

3. A visual signaling system for simultaneously flashing multiple strobe lights, said system comprising, in combination, a plurality of separate signaling units, means for providing dc electrical power to each of said units, each of said units incorporating a strobe light operable to emit flashes of light, capacitor means for storing power and electrically connected to said means for providing electrical power, means for achieving and maintaining a steady state voltage on said capacitor means, means electrically connected to each of said strobe lights and electrically connected with said means for storing power for periodically electrically energizing each of said strobe lights whereby all of said strobe lights simultaneously emit flashes of light, said system including means electrically connectable to said means for providing dc electrical power for polarizing said electrical power, said system including thermistor means electrically connected in series with each of said strobe lights and effective to limit electrical current applied to said strobe lights from said means for providing electrical power, said means for storing power including means for applying high voltage pulses to each of said strobe lights.

4. A visual signaling system for simultaneously flashing multiple strobe lights, said system comprising, in combination, a plurality of separate signaling units, means for providing dc electrical power to each of said units, each of said units incorporating a strobe light operable to emit flashes of light, capacitor means for storing power and electrically connected to said means for providing electrical power, means for achieving and maintaining a steady state voltage on said capacitor means, means electrically connected to each of said strobe lights and electrically connected with said means for storing power for periodically electrically energizing each of said strobe lights whereby all of said strobe lights simultaneously emit flashes of light, said system including means electrically connectable to said means for providing dc electrical power for polarizing said electrical power, said system including thermistor means electrically connected in series with each of said strobe lights and effective to limit electrical current applied to said strobe lights from said means for providing electrical power, said means for storing power including means for applying high voltage pulses to each of said strobe lights, said system including inductance means, and means for transferring electrical power from said inductance means to said capacitor means.

5. A visual signaling system for simultaneously flashing multiple strobe lights, said system comprising, in combination, a plurality of separate signaling units, means for providing dc electrical power to each of said units, each of said units incorporating a strobe light operable to emit flashes of light, capacitor means for storing power and electrically connected to said means for providing electrical power, means for achieving and maintaining a steady state voltage on said capacitor means, means electrically connected to each of said strobe lights and electrically connected with said means for storing power for periodically electrically energizing each of said strobe lights whereby all of said strobe lights simultaneously emit flashes of light, said system including means electrically connectable to said means for providing dc electrical power for polarizing said electrical power, said system including thermistor means electrically connected in series with each of said strobe lights and effective to limit electrical current applied to said strobe lights from said means for providing electrical power, said means for storing power including means for applying high voltage pulses to each of said strobe lights, said system including inductance means, means for transferring electrical power from said inductance means to said capacitor means, said system including means for applying power stored in said capacitor means to each of said strobe lights whereby the power stored in said capacitor means is dissipated through said strobe lights primarily in the form of said flashes of light flashing simultaneously.

6. A visual signaling system for simultaneously flashing multiple strobe lights, said system comprising, in combination, a plurality of separate signaling units, means for providing dc electrical power to each of said units, each of said units incorporating a strobe light operable to emit flashes of light, capacitor means for storing power and electrically connected to said means for providing electrical power, means for achieving and maintaining a steady state voltage on said capacitor means, and means electrically connected to each of said strobe lights and electrically connected with said means for storing power for periodically electrically energizing each of said strobe lights whereby all of said strobe lights simultaneously emit flashes of light.

* * * * *